United States Patent [19]

Mertens et al.

[11] 4,242,436

[45] Dec. 30, 1980

[54] PHOTOGRAPHIC MATERIAL FOR CONTINUOUS TONE REPRODUCTION

[75] Inventors: Ludovicus M. Mertens, Antwerp; Leon L. Vermeulen, Herenthout, both of Belgium

[73] Assignee: AGFA-GEVAERT N.V., Mortsel, Belgium

[21] Appl. No.: 958,386

[22] Filed: Nov. 7, 1978

[30] Foreign Application Priority Data

Dec. 15, 1977 [GB] United Kingdom ..... 52264/77

[51] Int. Cl.[2] ..... G03C 5/54; G03C 1/48

[52] U.S. Cl. ..... 430/248; 430/230; 430/233; 430/249; 430/965

[58] Field of Search ..... 96/29 R, 29 L, 52, 66.3, 96/95, 94 R, 96; 430/249, 248, 233, 965, 230

[56] References Cited

U.S. PATENT DOCUMENTS

| | | | |
|---|---|---|---|
| 3,674,481 | 7/1972 | Konig | 96/52 |
| 3,711,283 | 1/1973 | Young | 96/29 R |
| 3,985,561 | 10/1976 | DeHaes et al. | 96/29 R |
| 4,038,077 | 7/1977 | Land | 96/29 R |

*Primary Examiner*—Richard L. Schilling

*Attorney, Agent, or Firm*—William J. Daniel

[57] ABSTRACT

A photographic material suited for use in the silver complex diffusion transfer process and comprising at least one water-permeable layer and including a hydrophilic colloid silver halide emulsion layer in which the silver halide comprises a mixture of silver chloride and silver iodide and/or silver bromide, at least 90 mole % based on the total molar weight of the silver halide being silver chloride, and the ratio by weight of hydrophilic colloid to silver halide expressed as silver nitrate is between about 3:1 and about 10:1, wherein said at least one of the water-permeable layers contains a mixture of developing agents comprising an o-dihydroxybenzene and a 3-pyrazolidinone, the molar amount of the o-dihydroxybenzene in the mixture being larger than the molar amount of the 3-pyrazolidinone.

5 Claims, 2 Drawing Figures

PHOTOGRAPHIC MATERIAL FOR CONTINUOUS TONE REPRODUCTION

Figure 1:
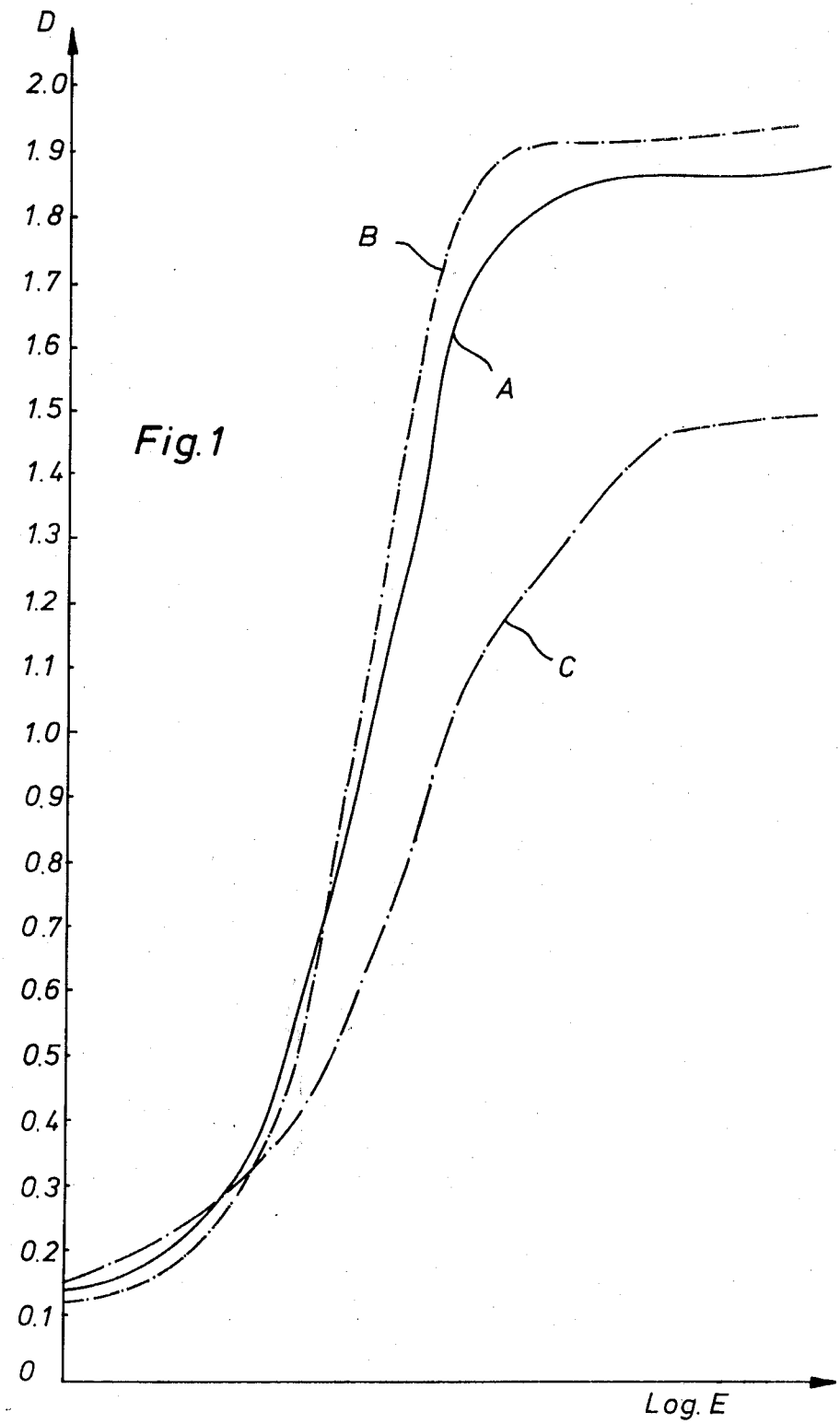

The present invention relates to a photographic material suitable for producing photographic images according to the well-known silver complex diffusion transfer reversal process.

The principles of the silver complex diffusion transfer reversal process, hereinafter also called DTR-process have been described e.g. in the U.S. Pat. No. 2,352,014 of André Rott issued June 20, 1944.

In the DTR-process, silver complexes are image-wise transferred by diffusion from a silver halide emulsion layer to an image-receiving layer, where they are converted, optionally in the presence of development nuclei, into a silver image. For this purpose, an image-wise exposed silver halide emulsion layer is developed by means of a developing substance in the presence of a so-called silver halide solvent. In the exposed parts of the silver halide emulsion layer the silver halide is developed to metallic silver so that it cannot dissolve anymore and consequently cannot diffuse. In the non-exposed parts of the silver halide emulsion layer the silver halide is converted into soluble silver complexes by means of a silver halide complexing agent (a so-called silver halide solvent) and transferred by diffusion to an adjacent image-receiving layer or to an image-receiving layer brought into contact with the emulsion layer to form, usually in the presence of development nuclei, a silver, or silver-containing image in the image-receiving layer. More details on the DTR-process can be found in "Photographic Silver Halide Diffusion Processes" by A. Rott and E. Weyde, Focal Press, London, New York (1972).

The reproduction of continuous tone images by the DTR-process requires the use of a recording material capable of yielding images with considerably lower gradation than is normally applied in document reproduction to ensure the correct tone rendering of continuous tones of the original. In document reproduction silver halide emulsion materials are used which normally mainly contain silver chloride. Silver chloride not only leads to a more rapid development but also to high contrast.

In the U.S. Pat. No. 3,985,561 of Louis Maria De Haes, Leon Louis Vermeulen, Hugo Karel Gevers, Stephan Jeanne Bongaerts, Paul Désiré Van Pee and Werner Krafft, issued Oct. 12, 1976, a light-sensitive silver halide material is described wherein the silver halide is predominantly chloride and yet this material is capable of forming a continuous tone image on or in an image-receiving material by the diffusion transfer process.

According to said U.S. patent a continuous tone image is produced by the diffusion transfer process in or on an image-receiving layer through the use of a light-sensitive layer which contains a mixture of silver chloride and silver iodide and/or silver bromide dispersed in a hydrophilic colloid binder e.g. gelatin, wherein the silver chloride is present in an amount of at least 90 mole % based on the total mole of silver halide and wherein the weight ratio of hydrophilic colloid to silver halide, expressed as silver nitrate, is between about 3:1 and about 10:1 by weight.

Generally the mole % of silver iodide and/or bromide based on the total mole of halide is comprised between about 0.1 and about 10 mole %, preferably between 0.5 and 5 mole %.

The light-sensitive materials used in the examples of said United States Patent contain in admixture with the silver halide, hydroquinone as main developing agent and 1-phenyl-4-methyl-3-pyrazolidinone as auxiliary developing agent.

With these light-sensitive materials successful reproduction of continuous tone images can be obtained probably as a result of the presence of the indicated amounts of silver iodide and/or silver bromide and of the defined high ratio of hydrophilic colloid to silver halide.

It has now been found that a still better continuous tone rendition can be obtained by using in or in conjunction with the light-sensitive layer with the same high ratio of hydrophilic colloid to silver halide a combination of silver halide developing agents consisting of an o-dihydroxy benzene compound, e.g. catechol, a 3-pyrazolidinone compound e.g. a 1-aryl-3-pyrazolidinone, and optionally a p-dihydroxybenzene compound, e.g. hydroquinone, the molar amount of the o-dihydroxybenzene in said combination being larger than the molar amount of the 3-pyrazolidinone, and the p-dihydroxybenzene (if any) being present in a molar ratio of at most 5% with respect to the o-dihydroxybenzene. Moreover, this combination offers the advantage of a more neutral image tone rendition.

The images obtained with the above three component developing agent combination have the property of withstanding very well loss of density under conditions of relatively high temperature and humidity.

In accordance with the present invention a photographic material suited for use in the silver complex diffusion transfer process comprises a hydrophilic colloid silver halide emulsion layer, wherein the silver halide comprises a mixture of silver chloride, and silver iodide and/or silver bromide, at least 90 mole % based on the total mole of the silver halide being silver chloride, and the ratio by weight of hydrophilic colloid to silver halide expressed as silver nitrate is between about 3:1 and about 10:1, and wherein said silver halide is in operative relationship with a mixture of developing agents comprising an o-dihydroxybenzene e.g. catechol, a 3-pyrazolidinone e.g. a 1-aryl-3-pyrazolidinone and optionally a p-dihydroxybenzene, e.g. hydroquinone the molar amount of the o-dihydroxybenzene in said mixture being larger than the molar amount of the 3-pyrazolidinone, and the p-dihydroxybenzene if any being present in a molar ratio of at most 5% with respect to the o-dihydroxybenzene.

By "operative relationship" between the developing agents and the silver halide is meant that the developing agents are in contact or can be brought into chemically reactive contact with the silver halide by application of an aqueous alkaline liquid to the photographic material for development processing therein. This means that the developing agents can be present in the silver halide emulsion layer itself or one or more of the developing agents may be present in a water-permeable layer that is not the silver halide emulsion layer but from which it or they can reach the emulsion layer by diffusion.

The use of a said small amount of a p-dihydroxybenzene yields a higher maximum image density and image stability but higher amounts especially of hydroquinone give rise to a rapid increase of gradation and prevents the advantage of a better continuous tone rendition.

By applying the above defined developer combination, the ratio of hydrophilic colloid (e.g. gelatin) to silver halide (expressed as silver nitrate) can be in the lower region of the above range, e.g. 3.5, without loosing the advantage of a very good continuous tone rendition. In consequence thinner silver halide emulsion layers can be coated at higher speeds.

Figure 2:
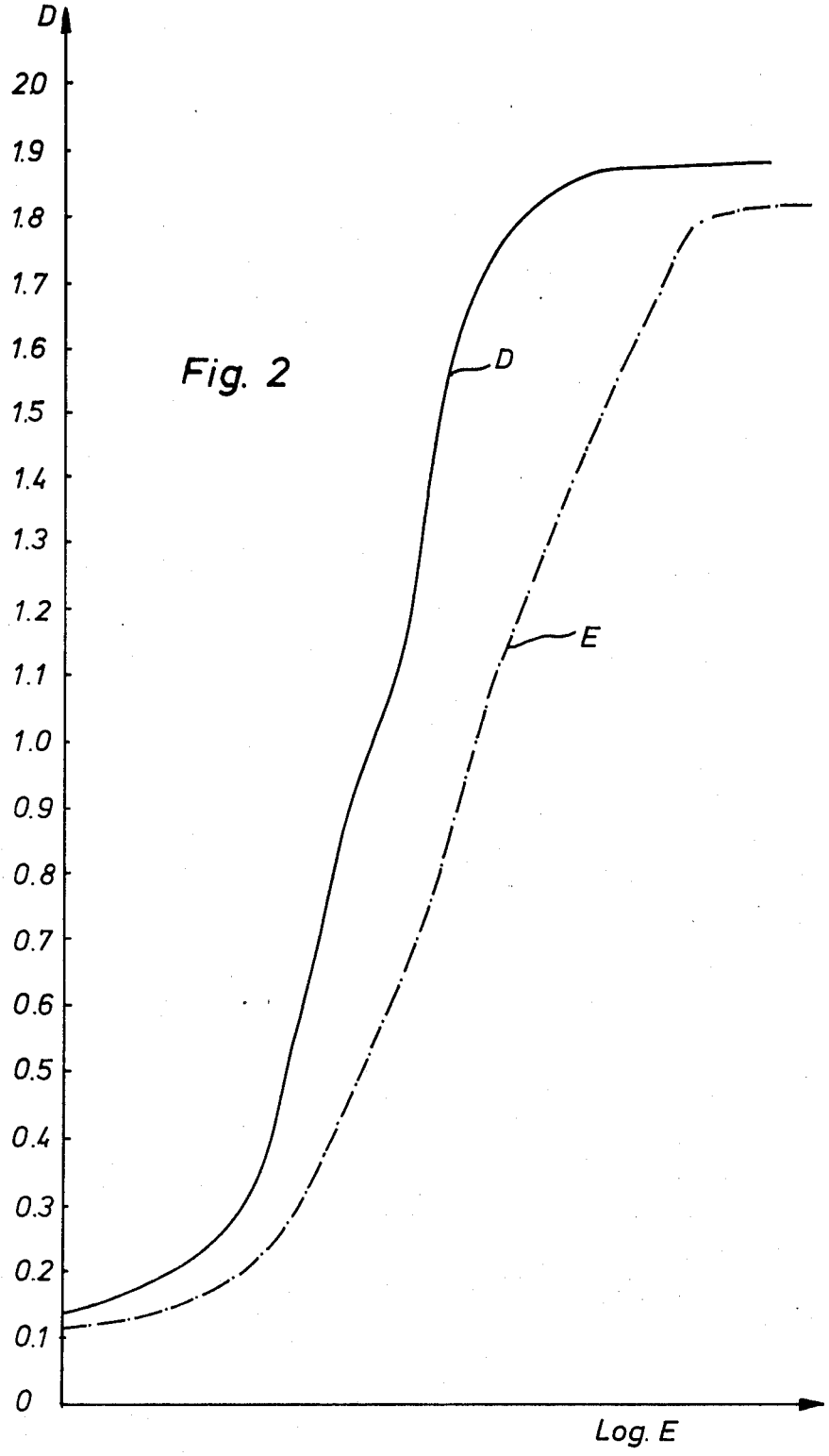

The accompanying FIGS. 1 and 2 contain sensitometric curves of continuous tone images obtained with prior art materials and with materials according to the present invention.

The preferred ortho-dihydroxybenzene for use according to the invention is catechol. Other catechol developing agents useful in the present invention are described e.g. in the U.S. Pat. No. 3,146,104 by Edward C. Yackel and Thomas I. Abbott, issued Aug. 25, 1964. 3-Pyrazolidinone developing compounds that are useful in the present material are within the scope of the following general formula:

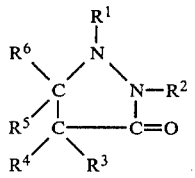

wherein:

$R^1$ represents an aryl group including a substituted aryl group e.g. phenyl, m-tolyl and p-tolyl, $R^2$ represents hydrogen, a lower ($C_1$–$C_3$) alkyl group e.g. methyl or an acyl group e.g. acetyl, each of $R^3$, $R^4$, $R^5$ and $R^6$ (which may be the same or different) represents hydrogen, an alkyl group preferably a $C_1$–$C_5$ alkyl group including a substituted alkyl group or an aryl group including a substituted aryl group.

3-Pyrazolidinone compounds within the scope of the above formula and suitable for use according to the present invention known e.g. from the United Kingdom Pat. No. 1,093,177 filed Dec. 16, 1964 by Gevaert Photo-Producten N.V., are the following:

1-phenyl-3-pyrazolidinone also known as PHENIDONE (trade name)
1-(m-tolyl)-3-pyrazolidinone
1-phenyl-2-acetyl-3-pyrazolidinone
1-phenyl-4-methyl-3-pyrazolidinone
1-phenyl-5-methyl-3-pyrazolidinone
1-phenyl-5,5-dimethyl-3-pyrazolidinone
1,5-diphenyl-3-pyrazolidinone
1-(m-tolyl)-5-phenyl-3-pyrazolidinone
1-(p-tolyl)-5-phenyl-3-pyrazolidinone and mixtures thereof. A preferred 3-pyrazolidinone compound for use according to the present invention is 1-phenyl-4,4-dimethyl-3-pyrazolidinone.

p-Dihydroxybenzene compounds that may be used according to the present invention include e.g. hydroquinone, and substituted hydroquinones e.g.

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone, or
2,5-diacetaminohydroquinone and mixtures thereof.

Hydroquinone is preferably used.

The o-dihydroxybenzene (A) and 3-pyrazolidinone (B) developing agents are used preferably in a (A) to (B) molar ratio which ranges between 10/1 to 10/3.

The mixture of the above developing agents (A) and (B), optionally combined with a p-dihydroxybenzene developing agent (C) is preferably used in an amount of between 0.3 to 3 g per sq.m and the amount of silver halide expressed as silver nitrate preferably ranges from about 0.5 to about 3.5 g per sq.m.

The binder for the photosensitive material is preferably gelatin. However, the gelatin may be wholly or partly replaced by other natural and/or synthetic hydrophilic colloids e.g. albumin, casein or zein, polyvinyl alcohol, alginic acids, cellulose derivatives such as carboxymethyl cellulose, etc. As referred to hereinbefore the weight ratio of hydrophilic colloid to silver halide expressed as silver nitrate is between about 3:1 and about 10:1; the preferred weight ratios being between 3.5:1 and 6.7:1.

In addition to the binder, silver halide and developing agents, the light-sensitive element may contain in the light-sensitive emulsion layer and/or one or more layers in water-permeable relationship with the silver halide emulsion layer any of the types of compounds customarily used in such layers for carrying out the silver complex diffusion transfer process. For example such layers may incorporate one or more coating aids, stabilizing agents or antifogging agents e.g. as described in the British Patent Specification No. 1,007,020 filed Mar. 6, 1963 by Agfa A. G., plasticizers, development modifying agents e.g. polyoxyalkylene compounds and onium compounds, spectral sensitizing agents, etc.

The silver halide emulsion for use in the silver complex diffusion transfer process for continuous tone reproduction is usually spectrally sensitized e.g. it may be sensitized panchromatically to ensure the reproduction of all colours of the visible part of the spectrum e.g. when black-and-white copies of coloured continuous tone transparencies are made. Light-sensitive materials containing differently spectrally sensitized silver halide emulsion layers according to the present invention can be used in conjunction with an image-receiving layer or material to produce therein a multicolour dye transfer image as described e.g. in the British Patent Specification No. 904,364 filed Sept. 11, 1958 by Kodak Ltd. Such dye images may be produced on either opaque or transparent supports.

The support for the light-sensitive silver halide emulsion may be any of the supports customarily employed in the art. These include supports of paper, glass or film e.g. cellulose acetate film, polyvinyl acetal film, polystyrene film, polyethylene terephthalate film etc. as well as metal supports and metal supports laminated at both sides with paper. Paper supports coated at one or both sides with an alpha-olefin polymer, e.g. polyethylene, can also be used. In order to compensate for the curling tendency of the light-sensitive material it is possible to coat one side of the support with a polyethylene layer whose specific density and/or thickness differs from that at the other side of the support. The compensating action can also be improved by the incorporation of matting agents into these coatings.

At least one side of the support is coated with the light-sensitive emulsion layer containing the mixture of silver chloride and silver bromide and/or silver iodide e.g. silver chloroiodide, silver chlorobromide or silver chlorobromoiodide.

The emulsion-coated side of the light-sensitive material can be provided with a top layer that is usually free from gelatin and contains water-permeable colloids. The top layer is of such nature that the diffusion is not inhibited or restrained and that it acts, e.g. as an antistress layer. Appropriate water-permeable binding agents for the layer coated on top of the light-sensitive silver halide emulsion layer are, e.g. methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, polyvinyl pyrrolidone, polyoxyethylene, copoly(methylvinylether/maleic acid), etc. The thickness of this layer may vary according to the nature of the colloid used. Such layer, if present, may be transferred at least partially to the image-receiving layer when the diffusion process comes to an end.

The preparation of the silver halide emulsion of the material according to the present invention proceeds in a known way by a precipitation reaction of halides e.g. ammonium halide and alkali metal halides e.g. potassium, sodium, lithium, cadmium and strontium halide with silver salts e.g. silver nitrate in a hydrophilic protective binder which is preferably gelatin. The silver halide is precipitated so that at least 90 mole % of the formed silver halide is silver chloride. Generally the mole % of silver iodide and/or silver bromide is between 0.1 and 10, preferably from 0.5 to 5 mole %. The developing agents are preferably added to the emulsion composition after the chemical ripening stage following the washing of the emulsion.

The image-receiving layer in or on which a continuous tone image can be formed according to the diffusion transfer process using a silver halide emulsion according to the present invention, normally forms part of a separate element. However it is likewise possible to use a so-called "mono-sheet" material wherein the light-sensitive layer and an image-receiving layer are present in one and the same material, such layers being carried by the same support.

An image-receiving material used in combination with the light-sensitive material according to the present invention may comprise an opaque or transparent support which includes supports of the kind described hereinbefore for the light-sensitive layer.

The image-receiving layer or a layer adjacent thereto may contain one or more agents for promoting the reduction to metallic silver of the complexed silver salt, these agents being called development nuclei. Such development nuclei have been described in the above-cited publication by A. Rott and E. Weyde, p.54–57. Preferably nickel sulphide nuclei are used. Development nuclei can also be incorporated into the processing liquid as is described in the United Kingdom Pat. No. 1,001,558, filed Apr. 13, 1962 by Gevaert Photo-Producten N.V.

In one or more layers of the image-receiving material, which may as just mentioned also be the light-sensitive material, substances may be incorporated, which play a prominent role in the formation of diffusion transfer images. Such substances include black-toning agents e.g. those described in the United Kingdom Pat. No. 561,875, filed Dec. 3, 1942 by Ilford Ltd. and in the Belgian Pat. No. 502,525 filed Apr. 12, 1951 by Agfa A. G. A preferred black-toning agent is 1-phenyl-5-mercaptotetrazole.

The image-receiving layer may consist of or comprise any of the binding agents mentioned hereinbefore for the silver halide. Gelatin is the preferred binding agent for the image-receiving layer.

The image-receiving layer may also comprise a silver halide solvent, e.g. sodium thiosulphate in an amount of about 0.1 to about 4 g per sq.m.

The surface of the image-receiving material may be provided with printing e.g. any type of recognition data applied by any type of conventional printing process such as offset printing, intaglio printing etc.

The processing liquid used in processing a photographic material according to the present invention usually contains alkali substances, such as tribasic sodium phosphate, preserving agents e.g. sodium sulphite, thickening agents e.g. hydroxyethyl cellulose and carboxymethyl cellulose, fog-inhibiting agents such as potassium bromide, silver halide-complexing agents as "solvents" e.g. sodium thiosulphate, black-toning agents especially heterocyclic mercapto compounds e.g. 1-phenyl-5-mercaptotetrazole, etc. The pH of the processing liquid is preferably in the range of 10 to 14.

The amount of sodium thiosulphate in said liquid is e.g. in the range of 17.5 g/l to 50 g/l.

The present invention includes a DTR-process in which the above photographic material is used for producing an image, in particular a continuous tone image in or on an image-receiving layer or sheet.

A process according to the present invention for producing a continuous tone image on a separate image receiving material comprises the steps of:

(a) exposing to an original a light-sensitive silver halide emulsion layer of a photographic material as hereinbefore defined, (b) contacting this photographic material while wet with aqueous alkaline liquid with a said image-receiving material containing developing nuclei to cause development of the exposed silver halide and to cause unexposed and undeveloped silver halide to become complexed by a silver halide complexing agent and to transfer to the image-receiving material on or in which the complexed silver halide becomes converted to a silver or silver-containing image with the aid of such developing nuclei, and (c) separating the said photographic and image-receiving materials.

For particulars about exposure and developing apparatus, which may be applied in a process according to the present invention reference is made e.g. to "Photographic Silver Halide Diffusion Processes" by A. Rott and E. Weyde, Focal Press London, New York 1972 and to the patent literature cited therein.

The light-sensitive material of the present invention finds an advantageous use in photographic cameras wherein continuous tone information has to be recorded, for example in portraiture. The excellent continuous tone reproduction, however, does not exclude the material from recording thereon documents and all kind of graphic art data so that the material is particularly suited at the same time for portraiture work and recording graphic data relating to the portraited person such as are present on documents of the kind of drivers licences, bank cheques, identity cards, etc. A photographic camera suitable for portraiture and graphic data recording and using a photographic silver halide material and receiving material for the DTR-process is described e.g. in the U.S. Pat. No. 4,011,570 by Emile Frans Stiévenart and Hugo Frans Deconinck, issued Mar. 8, 1977.

The light-sensitive material of the present invention is also suited for the production of continuous-tone antique photographs having a sepia or brown tone.

The silver complex diffusion transfer process has been introduced in old-time photography so as to yield imitations of portraits obtained in the earlier days of photography. A widely used method of making old-time photographs proceeds with a film consisting of an integral pack of positive-negative material operating with developer liquid released from so-called pods. Although such pack film produces prints with the desired continuous tone needed for portraiture there is the inconvenience of requiring a separate toning step. Authentic sepia appearance is normally obtained by bleaching and toning of the positive transfer print. The first bath bleaches the print and the second bath, e.g. a selenium toner, restores the print in a brown-toned mode. Apart from the time-consuming character of these additional steps one should take care in the handling of the selenium toning chemicals since they are particularly toxic.

It has been found that the brown or sepia toning of diffusion transfer prints for making antique photographs can be obtained in a much simpler and less time-consuming way by carrying out the silver complex diffusion transfer processing of a light-sensitive material according to the present invention or a high gelatin content silver halide material as described in U.S. Pat. No. 3,985,561, already mentioned hereinbefore, with a processing liquid containing at the time of the diffusion transfer thiosulphate ions in admixture with iodide ions and an organic heterocyclic mercapto toning compound cooperating with the iodide ions in the production of a desired brown or sepia tone of the transfer print.

Toning agents that can cooperate with iodide ions for the production of diffusion transfer images having a brown or sepia colour tone may be selected from the list of toning agents mentioned by André Rott and Edith Weyde in the book "Photographic Silver Halide Diffusion Processes"—The Focal Press London (1972) p. 61–65. A preferred class of compounds is the class of the 5-mercapto-1,2,4-triazoles.

When the photographic material does not contain any developing agent, which may be the case with the photographic materials of said U.S. patent, the alkaline aqueous liquid additionally contains the necessary development agent(s). Part of the developing agent(s) may be incorporated into the light-sensitive material and another part into said alkaline liquid and/or receptor material.

Authentic sepia appearance is obtained by using in the processing liquid containing the silver halide complexing agent: the mercapto compound that is tautomeric with 3-anilino-4-phenyl-Δ2-1,2,4-triazoline-5-thione as toning agent and iodide ions. The iodide ions are preferably used in a concentration corresponding with 10 mg to 500 mg preferably 75 mg of potassium iodide per liter. The concentration of toning agent may vary within wide limits but is preferably from at least 10 mg to 300 mg per liter. A deeper brown tone can be obtained by using in admixture with the above triazoline a minor amount of 1-phenyl-5-mercaptotetrazole, e.g. in the range of 5 mg to 55 mg per liter. A part of the toning agent(s) may be present in the receptor layer or material.

The 3-anilino-4-phenyl-Δ2-1,2,4-triazoline-5-thione is described in the French Patent Specification No. 1,470,235 filed Feb. 28, 1966 by Gevaert-Agfa N.V. as anti-sludge agent, i.e. a substance counteracting deposition of a silver-sludge in the processing liquid.

The following examples illustrate the present invention.

The ratios and percentages are by weight unless otherwise stated.

EXAMPLE 1

Photographic comparison material A (composed according to U.S. Pat. No. 3,985,561 identified above A gelatino silver halide emulsion was prepared by slowly running with stirring an aqueous solution of 1 mole of silver nitrate per liter into a gelatin solution containing per mole of silver nitrate 41 g of gelatin, 1.2 mole of sodium chloride, 0.08 mole of potassium bromide and 0.01 mole of potassium iodide.

The temperature during precipitation and the subsequent ripening process lasting three hours was kept at 40° C.

Before cooling, shredding and washing 214 g of gelatin were added per mole of silver halide. The washed noodles were molten and another 476 g of gelatin were added per mole of silver halide during the chemical ripening. After ripening 285 g of gelatin in the form of a 20% gel solution were added to the emulsion per mole of silver halide as well as hydroquinone in an amount such that after coating 0.9 g of hydroquinone were present per sq.m and 1-phenyl-4,4-dimethyl-3-pyrazolidinone in an amount such that 0.21 g thereof were present per sq.m. The emulsion was coated at one side of a subbed water-resistant paper support consisting of a paper having a weight of 110 g/sq.m coated at both sides with a polyethylene stratum at a ratio of 15 g/sq.m per side.

The emulsion was coated in such a way that an amount of silver equivalent to 2.3 g of silver nitrate was applied per sq.m; the amount of gelatin corresponding therewith is 13.73 g per sq.m since the gelatin to silver nitrate ratio was 5.97.

Photographic comparison material B

The preparation of the emulsion of comparison material B proceeded identically as described for comparison material A except for the fact that after the chemical ripening an addition of 68 g of gelatin in the form of a 20% gel solution took place.

The emulsion was coated in such a way that an amount of silver equivalent to 2.3 g of silver nitrate was applied per sq.m. Since the gelatin to silver nitrate ratio was 4.7, this corresponds with 10.81 g of gelatin per sq.m.

Photographic material C according to the present invention

The preparation of the emulsion of material C proceeded identically as described for comparison material A except for the fact that after the chemical ripening instead of hydroquinone catechol was added to the emulsion in an amount such that after coating 0.9 g thereof were present per sq.m and 1-phenyl-4,4'-dimethyl-3-pyrazolidinone in an amount such that 0.42 g thereof per sq.m were present.

The emulsion was coated in such a way that an amount of silver equivalent to 2.3 g of silver nitrate and an amount of gelatin corresponding with 13.73 g were present per sq.m. The gelatin to silver nitrate ratio was 5.97.

Image-receiving material

The image-receiving material used in conjunction with the above photographic materials A, B and C contained a paper support of 110 g/sq.m coated at both sides with polyethylene at a ratio of 15 g/sq.m per side. This support was treated with a corona whereupon, a layer was coated at a ratio of 18.1 sq.m/l from the following composition:

| | |
|---|---|
| carboxymethyl cellulose | 12 g |
| gelatin | 45 g |
| nickel sulphide nuclei (an aqueous suspension of 2% by weight of gelatin and 0.6% by weight of NiS) | 7 ml |
| water to make | 1000 ml |

Exposure and processing

The photographic materials A, B and C were exposed under identical conditions to a continuous tone wedge (wedge constant 0.1) in a reflex camera.

After the exposure the materials were introduced together with an image-receiving material into a diffusion transfer processing apparatus containing a liquid of the following composition:

| | |
|---|---|
| water | 800 ml |
| tribasic sodium phosphate . 12 $H_2O$ | 75 g |
| anhydrous sodium sulphite | 40 g |
| potassium bromide | 0.5 g |
| anhydrous sodium thiosulphate | 20 g |
| 1-phenyl-5-mercaptotetrazole | 70 mg |
| water to make | 1000 ml |

When the sandwich of each light-sensitive material and image-receiving material left the squeezing rollers of the diffusion transfer apparatus, the materials were still kept in contact for 60 s and then separated from each other.

The sensitometric curves A, B and C [Density (D) versus Logarithms of Relative Exposures (log E)] of the images obtained in the image-receiving material with the materials A, B and C respectively are given in FIG. 1.

The $\gamma$-values measured between density 0.3 and 1.4 were 2.68, 3.33 and 1.32 for the images obtained with the materials A, B and C respectively.

EXAMPLE 2

Photographic comparison material D (composed according to U.S. Pat. No. 3,985,561)

This material D was prepared in an identical way as comparison material A of example 1.

Photographic material E according to the present invention

The preparation of the emulsion of material E proceeded identically as described for comparison materials A and D except for the fact that after ripening an addition of 68 g of gelatin in the form of a 20% gel solution took place and a mixture of developing agents was used such that after coating of the emulsion 0.9 g of catechol, 0.42 g of 1-phenyl-4,4-dimethyl-3-pyrazolidinone and 0.009 g of hydroquinone were present per sq.m.

The emulsion was coated in such a way that per sq.m an amount of silver halide equivalent to 2.3 g of silver nitrate and 10.81 g of gelatin were present; the gelatin to silver nitrate ratio was 4.7.

The photographic materials D and E were exposed and DTR-processed as described in Example 1 for materials A to C.

The sensitometric curves D and E [Density (D) versus logarithms of Relative Exposures (log E)] of the images obtained in the image receiving material respectively with the materials D and E are given in FIG. 2.

The $\gamma$-values measured between density 0.3 and 1.5 were 2.8 and 1.90 for the images obtained with the materials D and E respectively.

EXAMPLE 3

Photographic material F

Photographic material F was prepared in the same way as material E of Example 2 with the difference that no hydroquinone was added.

Photographic materials G to I

Photographic materials G to I were identical to photographic material F with the difference however, that in their emulsion layers additionally were present 0.009 g, 0.018 g and 0.045 g per sq.m of hydroquinone respectively.

The exposure and processing of these materials proceeded as described for the materials of Example 1.

The images obtained in the image receiving material were subjected to a 12 h treatment in an incubation stove at 67° C. and 50% relative humidity. The following table contains the maximum densities and $\gamma$-values (measured between densities 0.3 and 1.5) obtained before said treatment and the maximum densities left after that treatment and also the percentage of density loss.

TABLE

| Material | $\gamma$ | DENSITY Before treatment | DENSITY After treatment | % of density loss |
|---|---|---|---|---|
| F | 1.87 | 1.62 | 1.34 | 17.3 |
| G | 2.00 | 1.64 | 1.42 | 13.4 |
| H | 2.26 | 1.70 | 1.50 | 11.8 |
| I | 2.50 | 1.78 | 1.62 | 9 |

EXAMPLE 4

Photographic material C of Example 1 was used in a portrait studio camera for old time picture taking. The exposed material was processed in conjunction with an image-receiving material as described in Example 1 but using in the processing liquid instead of the 1-phenyl-5-mercaptotetrazole, 75 mg of 3-anilino-4-phenyl-Δ2-1,2,4-triazoline as toning agent together with 75 mg of potassium iodide per liter.

When the sandwich of the exposed light-sensitive material and image-receiving material left the squeezing rollers of the diffusion transfer apparatus the materials as described in Example 1 were still kept in contact for 60 s and than separated from each other whereby on the image-receiving material a positive continuous tone transfer print of authentic sepia appearance is obtained.

We claim:

1. A process for producing an image in an image-receiving layer by a silver complex diffusion transfer process in which a photographic material comprising at least one water-permeable layer and including a water-permeable hydrophilic colloid silver halide emulsion layer in which the silver halide comprises a mixture of silver chloride and at least one of silver iodide and silver bromide, at least 90 mole % based on the total molar weight of the silver halide being silver chloride, and the ratio by weight of hydrophilic colloid to silver halide expressed as silver nitrate is between about 3:1 and about 10:1 is exposed to light, and contacted with an aqueous alkaline liquid and a silver complexing agent while in contact with said image-receiving material, wherein at least one of said photographic material layers contains a mixture of developing agents comprising an o-dihydroxybenzene and a 3-pyrazolidinone, the molar amount of the o-dihydroxybenzene in said mixture being larger than the molar amount of the 3-pyrazolidinone.

2. A process according to claim 1, wherein the silver complex diffusion transfer process is carried out with an alkaline aqueous processing liquid containing thiosulphate ions in admixture with iodide ions and an organic heterocyclic mercapto compound cooperating with the iodide ions in the producing of an image with brown or sepia tone.

3. A process according to claim 2, wherein said liquid contains iodide ions in a concentration corresponding with 10 mg to 500 mg of potassium iodide per liter.

4. A process according to claim 2 or 3, wherein said liquid contains as heterocyclic mercapto compound a tautomer of 3-anilino-4-phenyl-Δ2-1,2,4-triazoline-5-thione.

5. A process according to claim 4, wherein said compound is present in the processing liquid in a concentration of 10 to 200 mg per liter.

* * * * *